United States Patent [19]

Savage et al.

[11] 4,105,371

[45] Aug. 8, 1978

[54] CAM DRIVEN COMPRESSOR

[75] Inventors: Jack W. Savage, Centerville, Ohio; Thomas J. Savage, La Grange, Ill.

[73] Assignee: General Motors Corporation, Detroit, Mich.

[21] Appl. No.: 732,927

[22] Filed: Oct. 15, 1976

[51] Int. Cl.[2] ..... F04B 19/00; F04B 1/14

[52] U.S. Cl. ..... 417/238; 417/273

[58] Field of Search ..... 417/273, 271, 539, 238; 92/129, 169

[56] References Cited

U.S. PATENT DOCUMENTS

| | | | |
|---|---|---|---|
| 1,139,263 | 5/1915 | Erickson et al. | 92/165 |
| 1,723,874 | 8/1929 | Lunge | 417/539 |
| 1,964,679 | 6/1934 | Springfield | 417/238 |
| 2,980,024 | 4/1961 | Pope | 417/539 |
| 2,992,619 | 7/1961 | Nilges | 91/498 |
| 3,288,079 | 11/1966 | Kling | 92/129 |
| 3,313,215 | 4/1967 | Bieri | 92/165 |
| 3,426,696 | 2/1969 | Poynfer | 417/539 |
| 3,759,146 | 9/1973 | Brotherton | 92/169 |
| 3,912,421 | 10/1975 | Gelin | 417/273 |

FOREIGN PATENT DOCUMENTS

| | | | |
|---|---|---|---|
| 1,096,750 | 1/1961 | Fed. Rep. of Germany | 417/273 |
| 2,154,560 | 5/1973 | Fed. Rep. of Germany | 91/487 |
| 212,966 | 3/1924 | United Kingdom | 417/238 |
| 636,929 | 10/1948 | United Kingdom | 417/238 |

*Primary Examiner*—William L. Freeh

*Attorney, Agent, or Firm*—Edward P. Barthel

[57] ABSTRACT

A refrigerant compressor constructed for the addition of one or more pumping cylinders for the change of capacity. Improved mechanical efficiency is attained by means of a motor-driven eccentric cam imparting linear motion through one or more of the compressor pistons to the compression stroke and wherein the work to reciprocate each piston is assisted by dual out-of-phase compression springs. The cam is configured for producing a predetermined dwell-period when each piston reaches its bottom-dead-center position wherein a maximum gas charge will be inducted into the cylinder bore by the ram velocity effect of the inward moving gas stream. In a like manner the cam design provides piston dwell time at its top-dead-center position wherein an increased gas charge will be expelled per cycle resulting in increased volumetric efficiency.

4 Claims, 6 Drawing Figures

SIMPLE HARMONIC MOTION CAM PLATE

CYCLOIDAL MOTION CAM PLATE

CAM DRIVEN COMPRESSOR

This invention relates to improved reciprocating piston compressors and more particularly to a piston compressor having a single cylinder structure which may be modified to provide increased pumping capacity by the ready addition of one or more additional cylinders. Another aspect of the invention is the provision of a reciprocating compressor structure wherein an eccentric cam imparts linear motion to one or more pistons for the compression stroke and where the work to return the piston to its bottom-dead-center position is assisted by dual out-of-phase compression springs.

Reciprocating piston compressors have long been used but are limited for certain applications because of the fact that the piston compressors have a fixed volumetric displacement. This is particularly true of the compressors used in refrigeration systems such as room air conditioners and domestic refrigerators necessitating a manufacturer to produce a number of different sized compressors requiring an extensive amount of tooling.

It is an object of the present invention to provide an improved compressor having novel fabrication capabilities which allows the use of identical cylinder assemblies to be incorporated in building block fashion into a basic unit wherein the cylinder assemblies are selectively mountable in any of a plurality of mounting positions singularly or in multiples of two, three or four assemblies.

It is another object of the present invention to provide an improved reciprocal piston compressor having an eccentric cam cooperating with the piston rods of each of the pistons for providing extended dwell times at each piston bottom-dead-center and top-dead-center position, and in so dwelling, a larger gas charge will be inducted into the cylinders per cycle by the ram velocity effect of the inward moving gas stream; and whereby a greater gas charge will be expelled per cycle, thus increasing the volumetric efficiency of the compressor.

Still another object of the present invention is to provide an improved reciprocal piston compressor having variable capacity features wherein a one, two, three or four cylinder embodiment can be provided by virtue of the compressor structure providing a planar mounting surface with four mounting positions thereon around a drive shaft which is normal to the surface. Each of the mounting positions is adapted to receive interchangeably thereon one of four identical cylinder assemblies with each of the assemblies mountable on the surface singly or in multiples of two, three or four assemblies. The drive shaft has a rotatable eccentric cam with its periphery in a plane parallel to that of the compressor mounting surfaces. A piston reciprocates in each cylinder bore and has a piston rod with an exposed cam follower on its inboard end. The piston rods slide within rod guides that are essentially free of side loading while compression springs are sandwiched between the cam follower and guide member to bias each piston toward its inboard end of the cylinder bore and the cam follower against the exposed periphery of the cam surface when the cylinder assembly is in any of its four mounting positions.

Further objects and advantages of the present invention will be apparent from the following description, reference being had to the accompanying drawings wherein a preferred form of the invention is clearly shown.

Figure 1:
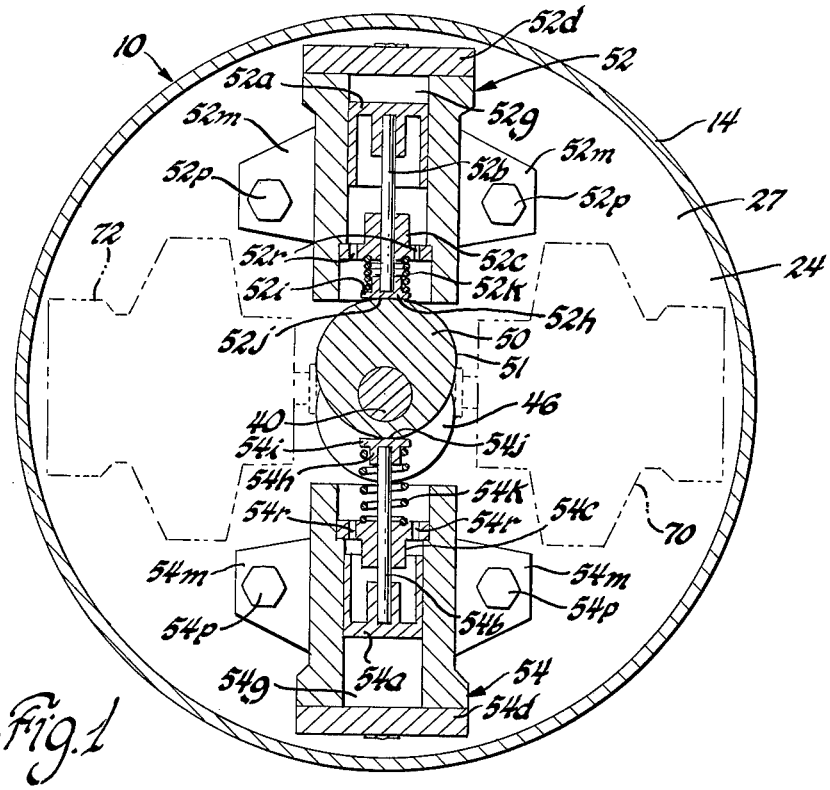
FIG. 1 is a vertical sectional view, taken through the center of the compressor cylinders.
Figure 2:
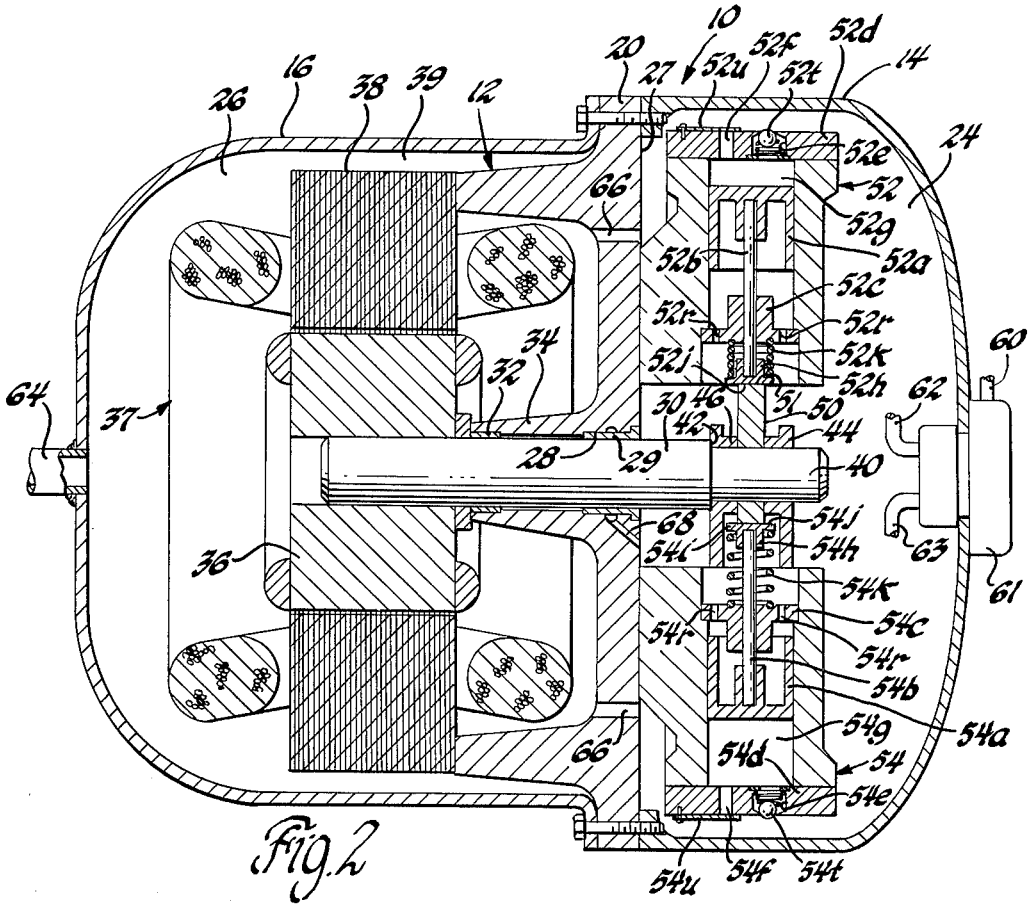
FIG. 2 is a vertical cross-sectional view, taken through the center of the assembled compressor.

Referring to the drawings, there is shown in FIGS. 1 and 2 a compressor 10 which comprises a metal casting frame 12 having metal end housings 14 and 16 which are preferably hermetically closed on plate wall 20. The wall 20, formed integrally with the casting 12, provides a partitioning means for dividing the interior of the housing 14 and 16 into side-by-side compartments 24 and 26. The wall provides a planar support surface 27 for mounting radial cylinders, to be described, in opposed relation. Wall 20 has a central hole 28 therethrough supporting a bearing 29 for a motor shaft 30. A second bearing 32 is provided in integral hub 34 for the shaft.

The portion of the shaft 30 within the compartment 26 has an armature or rotor 36 of an electric motor 37 mounted thereon for rotation thereof about the horizontal axis of the housing 14, 16. Thus the compartment 26 forms a motor compartment having a stator 38 of the electric motor housed therein. The motor stator 38 is spaced from the sides of the compartment 26, as at 39, to permit refrigerant and oil miscible therewith at one end of the electric motor to flow therefrom to the opposite end thereof toward wall 20.

The portion of the shaft 30 extending through the bearing 29 into the other compartment 24 has a reduced section 40 formed thereon so as to provide a shoulder 42 for positioning cam means. The cam means includes counterweights 44 and 46 on either side of eccentric cam 50, having peripheral surface 51, employed to actuate a compressor in the housing 14 and thus compartment 24 forms a compressor compartment. The compressor includes within the compartment 24 a plurality of radially disposed cylinders which in the disclosed embodiment are opposed cylinders 52 and 54 having suitable pistons **52*a* and 54*a* respectively, with their connecting rods 52*b*, 54*b* slidably extending through bores in rod guides 52*c* and 54*c*, respectively. Valve plates 52*d* and 54*d*, which are clamped on the head of each of the piston cylinders 52 and 54, are provided with inlet ports 52*e*, 54*e* suitably controlled by conventional spring biased ball valves 52*t*, 54*t* or the like, for admitting refrigerant to the cylinder bores 52*g*, 54*g*, above the pistons, and outlet ports 52*f*, 54*f* respectively, having leaf valve members 52*u* and 54*u*** for discharging refrigerant compressed by the pistons, as is well known in the art.

The outlet ports **52*f*, 54*f* connect to external line 60 via fitting 61 and internal lines 62 and 63 which lead to the compressor outlet ports 52*f* and 54*f*, respectively in accordance with standard practice. The gas to be compressed enters the motor compressor unit through the suction line 64 and is required to flow through the air gap between the motor stator 38 and the motor rotor 36 so as to cool the motor. The gas to be compressed leaves the motor chamber 26** through a plurality of apertures 66 provided in the wall 20 and then flows to the cylindrical bore inlet ports 52*e*, 54*e*. In this way the refrigerant having oil mixed therewith assists in lubricating the compressor by oil passages such as 68 to bearing 29 as is conventional.

Each of the piston or push rods 52*b*, 54*b* has an exposed cam follower 52*h*, 54*h* suitably affixed to its inboard end. The cam followers 52*h*, 54*h*, in the embodiment shown, are provided with an enlarged flanged follower tappet portion 52*i*, 54*i*, each having a planar contact surface 52*j*, 54*j* for tangential engagement with the periphery 51 of the cam 50. The assembly of the push rods and cam follower, with the tappet surface engaging the cam 50 as it is rotated, is used to effect axial movement of the pistons in a radially outward direction, and axial movement of the pistons in a radially opposite inboard direction is effected by helical compression springs 52*k*, 54*k* abutting at one end against the inboard end of the cylinder rod guides 52*c*, 54*c* and at their other end operatively engaging the push rods 52*b*, 54*b*, as by engagement with the tappets 52*i*, 54*i*.

Springs 52*k*, 54*k* normally bias the tappet of the push-rod assembly inward or inboard into engagement with the cam periphery 51 as shown by tappet 54*i* in FIGS. 1 and 2 with the piston 54*a* shown at its bottom-dead-center or bottom-out position in cylinder bore 54*g*. The piston 52*a* is shown at the top or outboard of its stroke in a top-dead-center position. In this position there should ideally be zero or substantially zero clearance between the piston 52*a* and the valve plate 52*d*. In the drawings a high clearance or volume is shown at top dead center between these elements for the purpose of illustration only and, of course, would be allied with a minimal clearance volume and a high compression ratio which are commercially in use.

It will thus be seen that the opposed compression springs 52*k*, 54*k*, which are out-of-phase with each other, theoretically require no energy input from the motor or prime mover 37 to return the pistons 52*a*, 54*a* from top-dead-center to bottom-dead-center after the compression stroke, since the energy contained in the compressed spring 52*k* gives up its stored energy to its paired spring 54*k* as it returns the piston 52*a* to its bottom-dead-center position. The energy quantity identified with the compressed spring is theoretically exchanged back and forth between the two springs during each revolution of the input shaft 30. Some additional energy, however, for spring compression is required by the input source or motor 37 during each revolution because of the frictional losses that are inherent in the disclosed compressor. It will be appreciated that by virtue of applicants' design the push rods 52*b*, 54*b* slide within the bores of their rod guides 52*c* so as to be essentially free of side loading because of the design of the cam 50 and cam followers 52*h*, 54*h*.

As seen in FIG. 1, wherein a two cylinder embodiment of the invention is shown, the cylinder 52 is formed with integral support wing-like gussets 52*m* and cylinder 54 with identical gussets 54*m*. It will be noted in FIG. 2 that the gussets have a planar rear surface which seats in a flush manner on upper wall planar surface 27. Suitable securing means, such as locking screws 52*p* and 54*p*, are provided to removably mount the cylinders 52, 54 on the surface 27 in 180° opposed relation. It will be noted that breather holes, shown at 52*r* and 54*r*, are provided in each rod guide so that the gas in the area between the pistons and the rod guides does not undergo compression on the intake stroke of the pistons.

Applicants contemplate a single cylinder form of the invention readily achieved by omitting the cylinder head or valve plate 54*d* and piston 54*a* of one of the cylinders such as the second cylinder 54. The single compression chamber compressor employs the second cylinder 54 as a support for the opposed spring 54*k*, rod 54*b*, rod guide 54*c* and cam follower 54*h*.

In the disclosed two cylinder embodiment of the invention, the opposed cylinder 54 has a cylinder head 54*d* and working piston 54*a* shown which is identical to the first cylinder assembly. A three cylinder embodiment of the invention is attainable by virtue of applicants' basic building block arrangement wherein a third cylinder, identical to cylinders 52 and 54, could be positioned in the area indicated by phantom line 70. In 180° opposed relation to the third cylinder position 70, indicated by phantom line area 72, a cylinder having a spring and rod guide could be provided in the manner of the single cylinder embodiment discussed above.

A four cylinder or double opposed form of the compressor is readily fabricated by merely converting the fourth cylinder in area 72 into a working cylinder assembly by the addition of its cylinder head and piston. A full four cylinder, single stage embodiment of the compressor can be manufactured without requiring additional design for new parts but simply a duplication of the parts required for a single cylinder form of the invention. Thus, as a progression is made from a one cylinder up through a four cylinder form of the subject invention, all that is required is a duplication of the parts used in the one, two or three cylinder form of the invention.

The above-mentioned basic single cylinder embodiment employing an 1800 r.p.m. electric motor having a 1/12 horsepower size would provide a 1/12 horsepower compressor with F-12 refrigerant, while a 1/6 h.p. compressor is achieved with the two-cylinder embodiment using a motor with a 1/6 h.p. rating. In a similar manner, a ¼ h.p. compressor could be readily assembled with three working cylinders and re-sizing the motor to ¼ h.p. A ⅓ h.p. compressor is envisioned with four working cylinders and re-sizing the motor for a ⅓ h.p. rating while using identical cylinder parts.

Further, changing the base line to 3600 r.p.m. electric motors and F-22 refrigerant, a ½ h.p. window air conditioner compressor is achieved with the two cylinder configuration using the cylinder interchangeable parts and employing a motor ½ h.p. in size. A one horsepower window air conditioner pump could be achieved by a full four working cylinder array and re-sizing the motor to a 1.h.p. size. In this manner the invention allows both a range of household refrigerator compressor sizes and high volume window air conditioner sizes with a single basic set of cylinder parts, two refrigerant gases and individually sized 1800 and 3600 r.p.m. electric motors.

Figure 3:
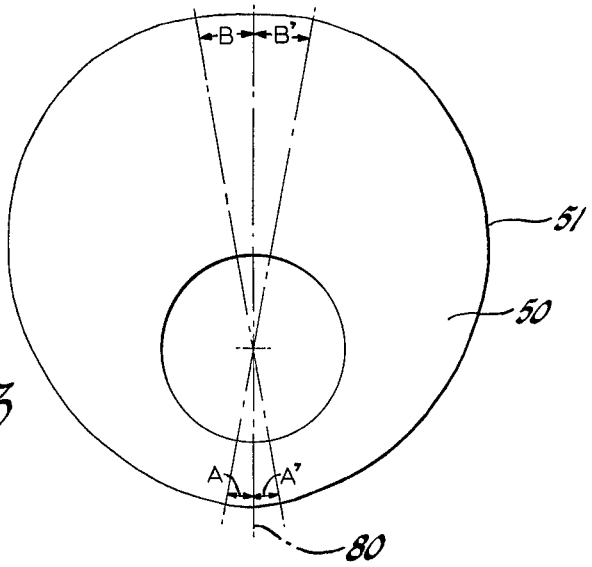
FIG. 3 is an enlarged detail view of the cam for use with the compressor.
Figure 4:
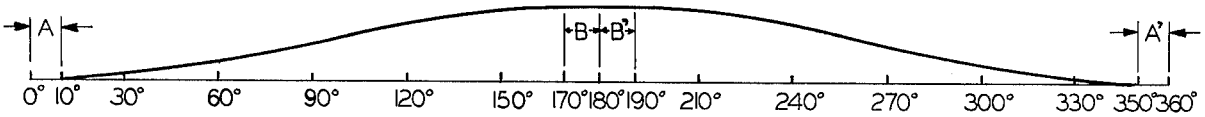
FIG. 4 is the developed curve for the FIG. 3 cam.

Turning now to FIG. 3, there is shown an enlarged detail view of the eccentric cam plate 50 having its peripheral surface 51 formed with a sinusoidal configuration or cam profile. The simple harmonic motion cam plate 50 design developed curve is shown in FIG. 4. It will be seen that the desired motion for the cam follower starting at 0° on the curve of FIG. 4, or vertical center line 80 of the cam plate in FIG. 3, provides one-half of a dwell angle A at bottom-dead-center of about 10°, followed by a rise of a predetermined stroke distance through an angle of 160° to a one-half dwell angle at top-dead-center defined by angle B, of about 10°. Further movement pass 180° of rotation beyond center line 80 defines the second half of the top-dead-center dwell angle of about 10° shown at B′ resulting in a travel through a predetermined stroke distance of about 160° to one-half of the dwell angle at bottom-dead-center, defined by angle A′ of about 10°. The result is a full dwell angle of about 20° at both top and bottom-dead-center piston positions.

Figure 5:
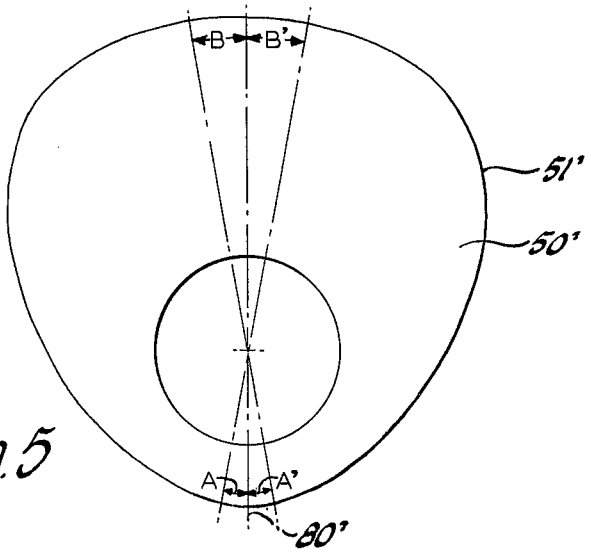
FIG. 5 is an enlarged detail view of a modified cam.
Figure 6:
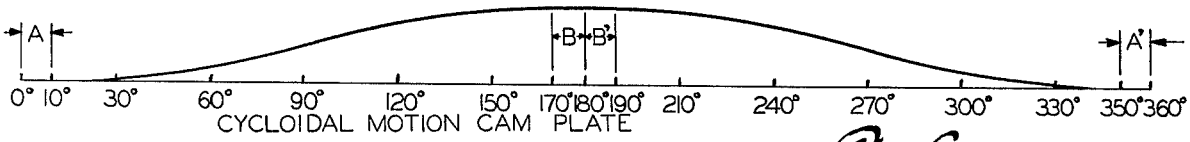
FIG. 6 is the developed curve for the FIG. 5 cam.

An alternate cam design is shown in FIGS. 5 and 6 wherein an enlarged detail view of the eccentric cam plate 50′ is shown having its peripheral surface 51′ formed with a cycloidal cam profile. The cycloidal motion cam plate 50′ design developed curve is shown in FIG. 6 and in the disclosed form provides a similar top-dead-center dwell angle of about 20° and a bottom-dead-center dwell angle of about 20°.

By virtue of applicants' cam design, as represented by cam 50, in combination with the reciprocation motion imparted to the pistons **52*a*, 54*a*, a dwell-time is provided by the cam 50 at th piston bottom-dead-center position. As a result the pistons 52*a* and 54*a* will remain stationary at their bottom-dead-center position for a predetermined unit of time and in so dwelling, a larger gas charge will be inducted into the cylinder bores 52*g* and 54*g* per cycle. This increased gas charge is caused by the ram velocity effect of the inward moving gas stream through intake valves 52*e* and 54*e*** to provide a greater induced charge per 360° cycle and consequently the compressor pump delivers more compressed gas per cycle.

In the same manner piston dwell time is provided by the cam 50 as the pistons near their top-dead-center positions. The predetermined time unit at which the pistons are momentarily stationary at top-dead-center will result in a greater gas charge being expelled per cycle with a consequent increase in the volumetric efficiency of the compressor.

While the embodiment of the present invention as herein disclosed constitutes a preferred form, it is to be understood that other forms might be adopted.

We claim:

1. A compressor of selectable configuration for changing the capacity thereof, said compressor comprising an exposed mounting surface having four mounting positions thereon around a drive shaft which is normal thereto, each of said mounting positions adapted to receive interchangeably thereat one of four identical cylinder assemblies, each of said cylinder assemblies selectively mountable on said surface in any of said mounting positions singly or in multiples of two, three or four such assemblies, said drive shaft having affixed thereto an eccentric cam the periphery of which rotates in a plane parallel to said mounting surface and is exposed thereon, each of said cylinder assemblies comprising a cylinder bore selectively opened and closed at an outboard end thereof by intake and exhaust valve means and closed at an inboard end thereof by a guide member, a piston reciprocable in said cylinder bore and having a piston rod affixed at one end to said piston and slidably received in said guide member, said piston rod having an exposed cam follower affixed to the other end thereof sandwiching a spring between said cam follower and said guide member to bias said piston toward said inboard end of the cylinder bore and said cam follower against the exposed periphery of said cam when said cylinder assembly is in any of said four mounting positions.

2. A compressor of selectable configuration for changing the capacity thereof, said compressor comprising an exposed mounting surface having four mounting positions thereon around a drive shaft which is normal thereto, each of said mounting positions adapted to receive interchangeably thereat one of four identical cylinder assemblies, each of said cylinder assemblies selectively mountable on said surface in any of said mounting positions singly or in multiples of two, three or four such assemblies, said drive shaft having affixed thereto an eccentric cam the periphery of which rotates in a plane parallel to said mounting surface and is exposed thereon, each of said cylinder assemblies comprising a cylinder bore selectively opened and closed at an outboard end thereof by intake and exhaust valve means and closed at an inboard end thereof by a guide member, a piston reciprocable in said cylinder bore and having a piston rod affixed at one end to said piston and slidably received in said guide member, said piston rod having an exposed cam follower affixed to the other end thereof sandwiching a spring between said cam follower and said guide member to bias said piston toward said inboard end of the cylinder bore and said cam follower against the exposed periphery of said cam when said cylinder assembly is in any of said four mounting positions, said cam periphery having a sinusoidal configuration thereon producing a predetermined dwell-period when each piston reaches its bottom-dead-center position in its cylinder bore, whereby a maximum gas charge will be inducted into the bore through its intake valve means by virtue of the ram velocity effect of the inward moving gas stream, and said cam periphery producing a predetermined dwell-period when each piston reaches top-dead-center position in its bore, whereby a maximum gas charge will be expelled through its exhaust valve means resulting in increased volumetric efficiency of said compressor.

3. The compressor of claim 2 in which said cam periphery having a cycloidal configuration thereon.

4. A radial compressor for a gas including a support member having a unit axis, a bored cylinder fixed on said support member, said cylinder having the axis of its bore in a transverse plane and having the inner end of said bore closed by a guide member, a drive shaft on said unit axis having one end rotatably mounted in said support member with said unit axis normal to said transverse plane, a cam member eccentrically mounted on said drive shaft for rotation therewith in said transverse plane, a piston slidable in said bore, said piston having a piston push rod extending through an aperture in said guide member, said piston rod having a cam follower member on its inner end portion cooperating with said cam member so that said piston moves radially outwardly to its top-dead-center position when said shaft rotates, said piston rod having a coiled wire compression spring positioned concentrically thereon between its cam follower member and said guide member such that said spring is compressed between its cam follower member and said guide member as said piston moves radially outwardly to its top-dead-center position when said shaft rotates, and the outer end of said cylinder bore having suction and discharge valve means for inducting and expelling gas, said cam member having a variable curvature peripheral surface thereon engaging said cam follower member, said surface configured with a first curvature in one location to produce a predetermined first dwell-period when said piston reaches its bottom-dead-center position, whereby a larger charge of gas to be compressed per cycle will be inducted into the bore through said intake valve means by virtue of the ram velocity effect of the inward moving gas stream, and said peripheral surface of said cam member configured with a second curvature in another location to produce a predetermined second dwell-period when said piston reaches said top-dead-center position, whereby a larger charge of compressed gas per cycle will be expelled through said exhaust valve means with said piston stationary at full compression for raising the volumetric efficiency of said compressor.

* * * * *